US005265976A

United States Patent [19]

Russell

[11] Patent Number: 5,265,976

[45] Date of Patent: Nov. 30, 1993

[54] COVER FOR PONDS

[75] Inventor: John V. Russell, Ivanhoe, Australia

[73] Assignee: Melbourne Water Corporation, Australia

[21] Appl. No.: 938,412

[22] Filed: Aug. 31, 1992

[30] Foreign Application Priority Data

Sep. 2, 1991 [AU] Australia ..... PK8104

[51] Int. Cl.[5] ..... E02B 3/00

[52] U.S. Cl. ..... 405/52; 405/60; 405/63

[58] Field of Search ..... 405/52, 53, 270, 60, 405/63–72

[56] References Cited

U.S. PATENT DOCUMENTS

| | | | |
|---|---|---|---|
| 1,909,484 | 5/1933 | Bjerregaard | 405/53 X |
| 2,211,958 | 8/1940 | Mahaffey | 405/53 X |
| 3,517,513 | 6/1970 | Renshaw et al. | 405/52 |
| 3,592,009 | 7/1971 | Alkmaar | 405/53 |
| 3,815,367 | 6/1974 | Collins et al. | 405/52 |
| 4,483,641 | 11/1984 | Stoll | 405/53 X |
| 4,678,368 | 7/1987 | Helversen | 405/52 X |
| 4,735,524 | 4/1988 | Dunkers | 405/52 X |
| 5,035,536 | 7/1991 | von Winckelmann | 405/64 X |

FOREIGN PATENT DOCUMENTS

| | | | |
|---|---|---|---|
| 13780 | of 1928 | Australia | 405/53 |
| 0628219 | 10/1978 | U.S.S.R. | 405/53 |

*Primary Examiner*—Dennis L. Taylor

*Attorney, Agent, or Firm*—Lerner, David, Littenberg, Krumholz & Mentlik

[57] ABSTRACT

A lagoon cover made up of a number of individual sections, each of which has a body formed of flexible sheet material. The cover sections are releasably connected together in edge to edge relationship, and the connection is such that each section may rise or fall relative to adjacent sections. Buoyancy means is attached to the body of each section to support that section on the lagoon, and each section also preferably has stabilizing means which is at least partially immersed in the lagoon and serves to resist movement of the section across the lagoon. Gas transfer means is provided so that gas caught in the space between the cover and the lagoon surface, can be transferred from one part of the cover to another. Pressure relief means is also provided to automatically relieve excessive build-up of pressure in that space.

24 Claims, 3 Drawing Sheets

COVER FOR PONDS

This invention relates to covers for lagoons, ponds, and the like, and in particular but not exclusively is concerned with anaerobic sewerage lagoons. It will be convenient to hereinafter describe the invention with particular reference to anaerobic sewerage lagoons, but it is to be understood that the invention has other applications. Also, the term "lagoon" is to be understood as embracing ponds and other expanses of water or other liquid which may benefit from having a cover.

Sewerage lagoons may extend over large areas—e.g., nine hectares or more—and in some circumstances present an odour problem. Attempts have been made to provide covers for such lagoons so as to capture the odoriferous gases which rise from the surface of the lagoon, but such covers have not been entirely successful. Because of the area involved, lagoon covers have generally been formed of a flexible sheet material. Such sheet material covers suffer a lack of stability in use due to their tendancy to lift from the lagoon surface under windy conditions. It is therefore usually the case that such covers are considered unsuitable for areas larger than three hectares.

It is an object of the present invention to provide a lagoon cover which can satisfactorily extend across a large area, and in particular can retain a satisfactory degree of stability while extending over such an area. It is a further object of the invention to provide a cover section which can be releasably connected to one or more similar cover sections so as to form a cover of the aforementioned kind.

A cover according to the invention is characterized in that it is composed of a plurality of interconnected sections, and that the connection between adjacent sections is releasable and enables the adjacent sections to be movable relative to one another. The arrangement is such that localised loads, as might be caused by windy conditions, are shed across the cover due to the ability of the cover sections to move relative to one another.

It is usually preferred to form each cover section of rectangular shape, but other shapes could be adopted. The releasable interconnection between adjacent sections can be of any suitable type, but a lacing type of connection has been found to be suitable.

A cover section according to the invention is characterized in that it includes a body formed of flexible sheet material, connecting means at the periphery of that body to enable the section to be attached to at least one other section, and buoyancy whereby the section will be supported on the surface of a liquid. It is preferred that stabilizing means is attached to the body and is operative to resist movement of the cover section relative to the surface over which it is located.

In a preferred arrangement, at least some of the sections which make up a cover assembly are each provided with gas transfer means whereby gas can be transferred from one part of the cover assembly to another. The cover assembly might also be provided with safety release means which operates to allow the escape of gas in the event of an excessive build-up occurring beneath the cover.

Embodiments of the invention are described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 1:
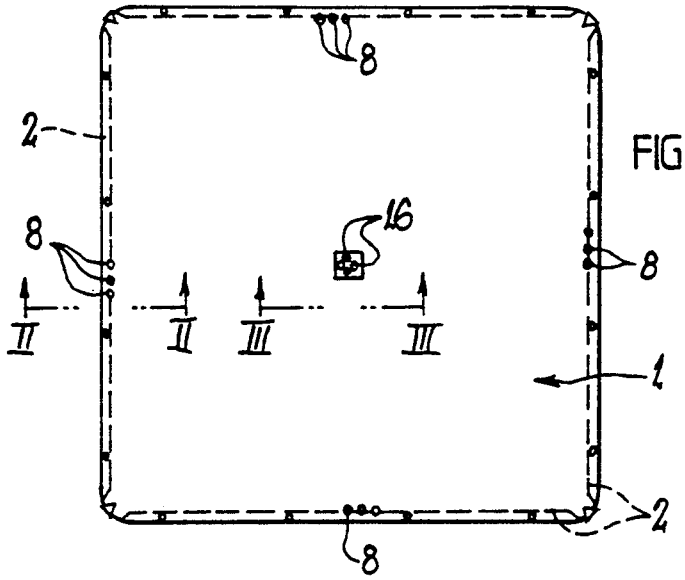
FIG. 1 is a diagrammatic plan view of a cover section in accordance with one embodiment of the invention.

In the particular example shown in the drawings, each cover section includes a body 1 of substantially square peripheral shape and which is formed of a flexible sheet material such as low density polyethylene. Other peripheral shapes are clearly possible, and other materials could be used. Again by way of example, the length of each side of the body 1 may be roughly 500 centimeters, and satisfactory results could be achieved with tiles of other dimensions.

Each body 1 is provided with buoyancy means, and in the particular example shown that is formed by an inflatable buoyancy chamber 2 provided along each side of the body 1. The chamber 2 shown is in the form of an elongate cylinder, but other forms are possible. The chamber 2 may be a single continuous chamber extending completely around the periphery of the body 1, but it is usually preferred to have an individual chamber 2 at each of the four sides of the body 1. Any suitable means may be provided to enable air, for example, to be pumped into each chamber 2 so as to inflate it and condition it to function as a buoyant member. Valve means may be provided to enable each tubular chamber 2 to be exhausted of air and deflated for storage or transport purposes.

It will be appreciated that the buoyancy means could take other forms, such as one or more sections of foam plastics or other buoyant material.

Any suitable stabilizing means may be provided on the body 1, and in the particular arrangement shown that stabilizing means includes a ballast member 3 suspended beneath and connected to each buoyancy chamber 2. It is to be understood however, that such a ballast member 3 need not be provided at every side of the section body 1, and may be located remote from the buoyancy chambers 2, such as at the center of the body 1. The particular ballast member 3 shown, is in the form of a hollow tube which is adapted to receive a quantity of water or other ballast material. The ballast members 3 of the body 1 may be connected end to end so as to function as a single member, but it is generally preferred to have them separate as shown. It is also preferred that means be provided to permit ballast material to be removed from each member 3 to facilitate storage or transport of the cover section.

Figure 2:
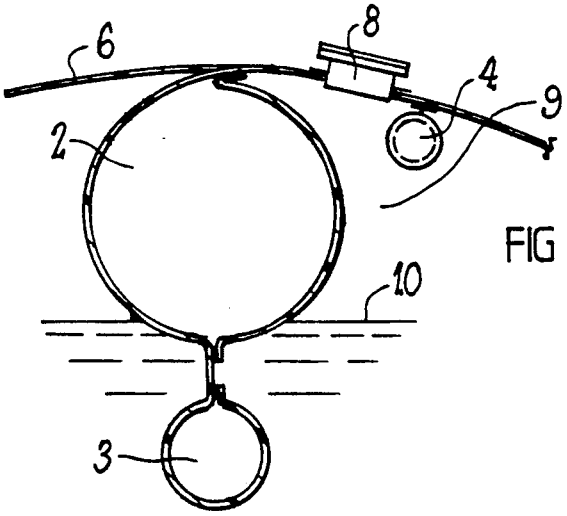
FIG. 2 is an enlarged cross-sectional view taken along line 2—2 of FIG. 1.

The primary function of the ballast members 3 is to give some positional stability to the body 1 of the cover section. As shown in FIG. 2, in use, each ballast member 3 is immersed in the lagoon over which the cover extends, and as a result resists movement of the cover section body 1 across that lagoon.

In view of the flexible nature of the body 1 of the cover section, it may be desirable to provide rigidifying means along each side of the body 1. The ballast members 3 may function as rigidifying means, but in the arrangement shown in FIG. 1, the rigidifying means comprises a relatively rigid rod or tube 4 secured along the relevant side edge portion of the body 1. In one example, the rigidifying means is a section of PVC pipe having slots or other openings formed through its wall so that it has no buoyancy. Any suitable means may be adopted to secure the tube 4 to the body 1 of the cover section.

The tubes 4 serve to resist lateral collapse or folding of the cover section body 1 so that in use the cover section substantially retains its square or rectangular shape. Two or more of the tubes 4 may be removable from the body 1 to enable the body 1 to be rolled or folded and thereby facilitate storage or transport of the cover section.

Figure 4:
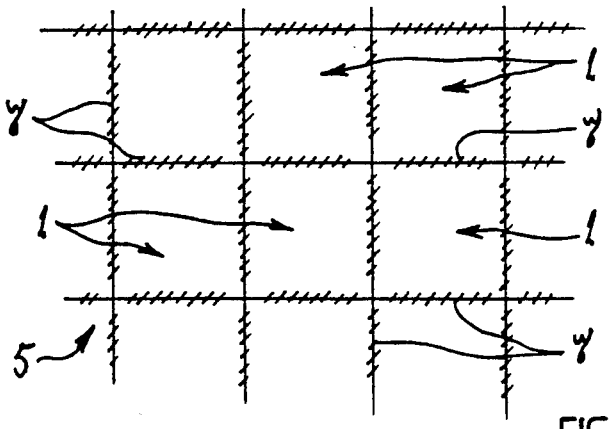
FIG. 4 is a diagrammatic plan view of part of a cover assembly composed of a plurality of cover sections as shown in FIG. 1.

A plurality of cover sections as described may have their respective bodies 1 connected together in edge to edge relationship so as to form a cover assembly 5, part of which is shown diagrammatically in FIG. 4. Any suitable connecting means may be employed. In the arrangement shown in the drawings, a flap 6 is provided along each side or each body 1, and has a series of holes (not shown) formed therethrough. A flap 6 of one body 1 can be connected to a flap 6 of an adjacent body 1 by lacing 7, or the like, extending through the aforementioned holes as shown diagrammatically in FIG. 4.

The connecting means described is releasable to enable separation of the cover sections, and has the further advantage of not impeding relative up and down movement of adjacent bodies 1. The latter point can be significant if the cover assembly 5 is used in circumstances where wind, for example, may cause the assembly 5 to be subjected to localised loading. The ability of each cover section body 1 to lift to some extent relative to adjacent bodies 1 enables dissipation of any such loading so that the stability of the structure is not significantly disturbed. The connection between adjacent bodies 1 in effect acts as a hinge for the foregoing purpose.

In the event that a cover assembly 5 as described is used over an anaerobic sewerage lagoon, gases rising from the surface of the lagoon will tend to collect beneath one or more portions of the assembly 5. It is therefore preferred that the assembly 5 is provided with gas transfer means whereby gases beneath one portion of the assembly can be transferred away from that portion. By way of example, the transfer system may be such that the gases can be drawn-off at a suitable part of the cover assembly 5 for disposal or use as required.

Figure 5:
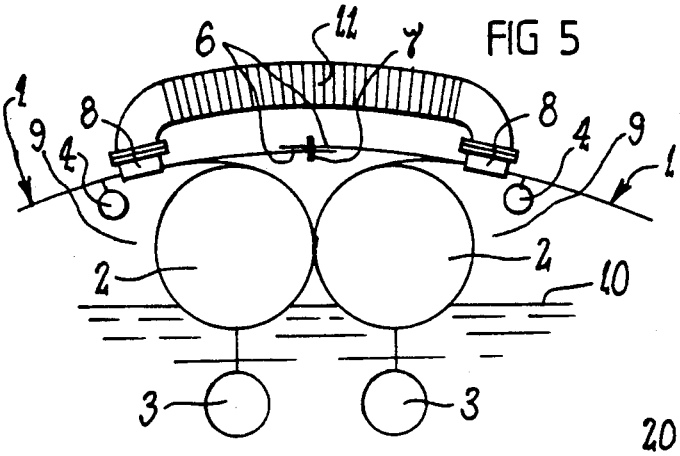
FIG. 5 is a cross-sectional view of part of a cover assembly as shown in FIG. 4, and which is in accordance with one embodiment of the invention.

The particular cover section body 1 shown in FIGS. 1, 2 and 5, includes gas transfer means in the form of a plurality of tube sections 8, each of which extends through the body 1 adjacent an edge thereof. Each tube section 8 provides an open ended passage which communicates at its lower end with the space 9 between the lagoon surface 10 and the body 1 of the cover section (FIGS. 2 and 5).

When the cover section bodies 1 are included in a cover assembly 5, a tube section 8 of one cover section body 1 can be connected to a tube section 8 of an adjacent cover section body 1 by an open ended conduit 11 (FIG. 5) of any suitable form. It is preferred that the conduit 11 is flexible for at least part of its length so as not to impede relative movement of the bodies 1 to which it is connected. A plurality of such transfer connections may be made between adjacent cover sections, and the locations of such connections can be selected to confine the passage of gases for collection or distribution purposes. Unused tube sections 8 can be closed off by a removable closure plate or plug (not shown).

Figure 6:
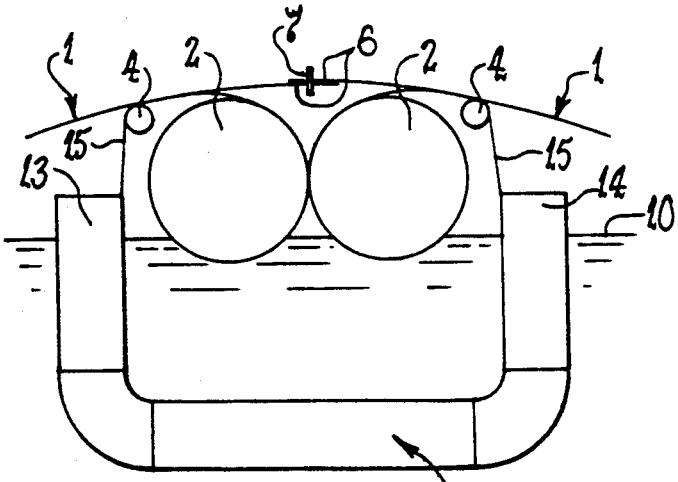
FIG. 6 is a view similar to FIG. 5 but showing another embodiment of the invention.

An alternative gas transfer system is shown in FIG. 6. In that alternative arrangement, a U-shaped section of open ended tube 12 is partially submerged in the body of the lagoon with its opposite ends 13 and 14 exposed above the water level 10 and located beneath respective adjacent cover section bodies 1. Any suitable means 15 may be provided to connect the tube 12 to the bodies 1.

There may be circumstances under which gas rising from the lagoon surface 10 beneath one or more cover sections cannot escape, or cannot escape with sufficient speed through the transfer system. In order to cope with that eventuality, each body 1, or at least some of the bodies 1, in a cover assembly 5 may be provided with relief means which opens to allow escape of gas in response to excessive gas build-up beneath the relevant cover section. Such relief means could be of any suitable form.

Figure 3:
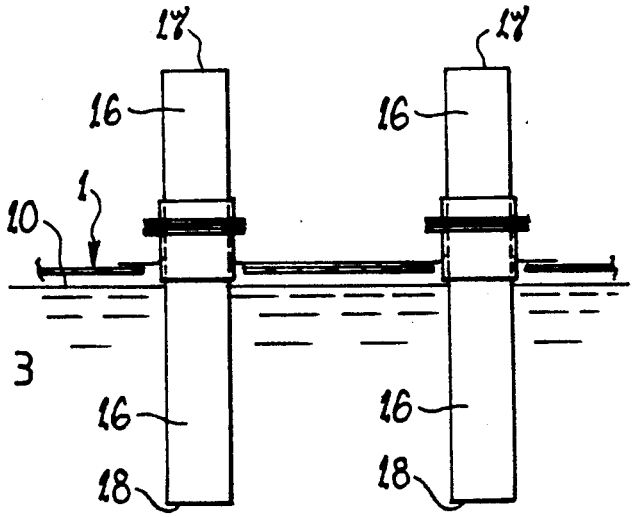
FIG. 3 is an enlarged cross-sectional view taken along line 3—3 of FIG. 1.
Figure 7:
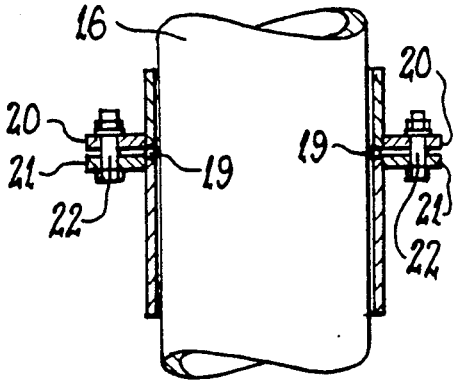
FIG. 7 is a cross-sectional view of the adjusting means for the pressure relief tubes shown in FIG. 3.

In the particular arrangement shown in FIGS. 1, 3 and 7, the relief means includes at least one open ended tube 16 extending through the body 1 of the cover section so as to have its opposite ends 17 and 18 located beyond respective Opposite surfaces (upper and lower) of the body 1. It is preferred to provide a plurality of such tubes 16, and it is further preferred to locate them in a central region of the body 1 as shown in FIG. 1. In normal operation, the lower end 18 of each tube 16 is located beneath the water level 10 so that the tube 16 is thereby closed against the passage of gas (FIG. 3). If gas build-up occurs beneath the body 1, that body will lift at its center so as to accommodate the increasing volume of gas, and a stage will be reached at which the lower end 18 of at least one tube 16 is exposed above the water level 10, thereby allowing escape of gas to the atmosphere.

Adjustment means may be provided to enable the relief tubes 16 to be adjusted as required to control the conditions under which they operate to allow escape of gas. One form of such adjustment means is shown in FIG. 7. In that particular arrangement, the axial position of the tube 16 is fixed by a resilient O-ring 19 which is compressed between two rigid annular flanges 20 and 21 so as to be squeezed against the outside surface of the tube 16 to firmly grip that tube. Adjustment of the axial position of the tube 16 is effected by releasing the clamp bolts 22 which hold the flanges 20 and 21 against separation, and thereby allowing the O-ring 19 to return to its undeformed condition at which it is disengaged from or only lightly engages the tube 16. When the tube 16 has been adjusted to a selected axial position, that position is fixed by tightening the bolts 20.

It will be apparent from the foregoing description that cover sections according to the invention are able to be conveniently joined to form a cover assembly of any desired size. The assembly can be constructed in stages from the shore of a lagoon and progressively moved out over the lagoon surface as each stage is completed. Alternatively, it can be constructed from one or more floating workstations located on the lagoon. A cover assembly could be composed in part by cover sections as described, and in further part by other components as considered appropriate to the circumstances, including cover sections not having every one of the features previously described. Also, such other components might include strips of material of appropriate width which are used to interconnect groups of cover sections as described. Furthermore, a cover assembly could be composed in total, or in part, of cover sections as described which are of various dimensions.

The cover assembly 5 can be secured in position in any suitable manner. By way of example, the periphery of that assembly can be firmly secured to the walls or banks which define the perimeter, or part of the perimeter, of the lagoon. Alternatively, the cover assembly 5 may be secured in a manner such as to automatically compensate for variations in the level of the lagoon. One such arrangement is shown diagrammatically by FIG. 8.

Figure 8:
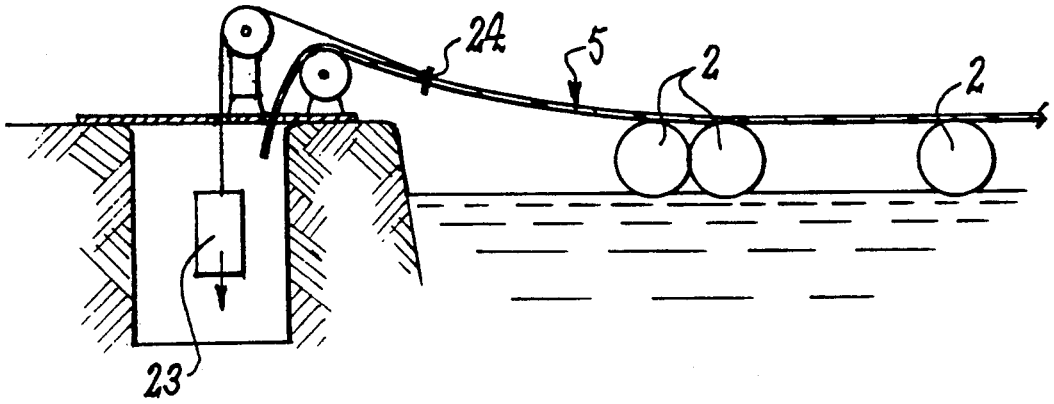
FIG. 8 is a diagrammatic view of one method of securing the edges of a cover assembly as shown in FIG. 4.

In the FIG. 8 arrangement, each of a plurality of weights 23 is attached as at 24 to an edge portion of the assembly 5, and is arranged to maintain tension across the span of the assembly 5. That tension remains substantially constant in spite of rises and falls in the level of the lagoon. Any suitable number of weights 23 may be arranged along each edge of the assembly 5, or at least along such edges which are adjacent a bank or wall of the lagoon.

A cover section as described has a number of advantages which make it well suited for use in any of a variety of circumstances. The provision of peripheral buoyancy results in each section having an inherent peripheral seal so as to control the escape of gases and odours. That sealing facility is made relatively secure for various conditions of use by the provision of the ballast or stabilizing means. Provision of gas transfer means and/or gas relief means as described gives the cover section features not presently found in lagoon covers, or components for such covers.

Cover sections according to the invention enable the construction of an effective and secure cover of very large size.

Various alterations, modifications and/or additions may be introduced into the constructions and arrangements of parts previously described without departing from the spirit or ambit of the invention as defined by the appended claims.

I claim:

1. A lagoon cover section adapted to be releasably connected to at least one corresponding cover section, said lagoon cover section including, a body having a plurality of side edges with peripheral portions thereon, said body formed of flexible sheet material, buoyancy means attached to said body and being operative to support said lagoon cover section on the surface of a lagoon so that said lagoon cover section can be releasably connected to said corresponding cover section and disconnected therefrom when in use, said buoyancy means extending along at least one of said side edges of said body, and connecting means arranged on at least one of said peripheral portions of said at least one side edge for releasably attaching said at least one peripheral portion to said at least one corresponding cover section, wherein said connecting means is operative to provide for relative movement between said lagoon cover section and said at least one corresponding cover section so that both of said cover sections are free to move relative to one another about an axis extending generally parallel to said side edge.

2. A cover section according to claim 1, including stabilizing means attached to said body.

3. A cover section according to claim 2, wherein said stabilizing means is attached to said body so as to be suspended below an undersurface of said body and at least partially immersed in a lagoon over which said cover section is located.

4. A cover section according to claim 3, wherein said stabilizing means includes a hollow member adapted to receive a quantity of ballast material.

5. A cover section according to claim 1, including rigidifying means attached to said body and which is operative to hold said body against substantial lateral collapse or folding in at least one direction.

6. A cover section according to claim 5, wherein said rigidifying means includes a relatively rigid elongate member extending along and attached said to at least one side edge portion of said body.

7. A cover section according to claim 6, wherein said body is generally rectangular, said body including an elongate member extending along said plurality of side edges and being attached thereto.

8. A cover section according to claim 1, wherein said buoyancy means includes at least one inflatable buoyancy chamber.

9. A cover section according to claim 8, wherein said body is generally rectangular and said at least one buoyancy chamber comprises a plurality of buoyancy chambers, one of said plurality of buoyancy chambers is provided at each of said side edges.

10. A cover section according to claim 1, including opening means extending through said body and being connectable to gas transfer means.

11. A cover section according to claim 1, including pressure relief extending through a central portion of said body.

12. A lagoon cover including a plurality of interconnected sections, each said section including a body having a plurality of side edges with peripheral portions thereon, said body formed of flexible sheet material, buoyancy means attached to at least some of said sections and being operative to support respective said sections on the surface of a lagoon so that adjacent ones of said sections are accessible to be releasably connected to and disconnected from each other, each said buoyancy means extending along at least one of said side edges of said body of an associated section, and releasable connection means for releasably interconnecting said peripheral portions of adjacent ones of said sections, wherein each of said releasable connection means is operative to provide for relative movement between said adjacent interconnected sections such that said adjacent interconnected sections are free to move relative to one another about an axis extending generally parallel to said peripheral portions.

13. A lagoon cover according to claim 12, wherein said releasable connection means provides a hinge-like connection between said adjacent ones of said sections.

14. A lagoon cover according to claim 12, including gas transfer means which is operative to transfer gas from the space between the body of one said section and the surface of said lagoon, to the corresponding space beneath the body of another said section.

15. A lagoon cover according to claim 14, wherein said gas transfer means includes an open ended conduit extending over at least one said connection and having each of its opposite ends connected to a respected one of two openings, each of which is formed through the body of a respective one of said sections.

16. A lagoon cover according to claim 15, wherein said conduit is flexible between said ends thereof.

17. A lagoon cover according to claim 14, wherein said gas transfer means includes an open ended tube arranged to be partially immersed in the body of a lagoon over which said cover extends and positioned so that each open end thereof communicates with a space beneath a respective one of two said sections, and each said space is formed between the body of the respective said section and the surface of said lagoon.

18. A lagoon cover according to claim 12, including pressure relief means which is operative to relieve pressure build-up in a space between said cover and the surface of a lagoon over which said cover is located.

19. A lagoon cover according to claim 18, wherein said relief means is provided in at least one said section and includes an open ended tube extending through part of the body of that section so as to have a lower open end beneath said body part and an upper open end above said body part, and the distance said lower end is beneath said body part is predetermined so that said lower end will be exposed above the surface of a lagoon or will be immersed in that lagoon, according to whether or not respectively excessive pressure exists in the space between said cover section body and the lagoon surface.

20. A lagoon cover according to claim 19, wherein adjustment means is provided to enable selective variation of said distance.

21. A lagoon cover according to claim 12, wherein each said section is of substantially rectangular form, and said buoyancy means extends at least part way along each of said plurality of side edges.

22. A lagoon cover according to claim 12, including stabilizing means attached to at least some of said sections and being suspended beneath said cover so as to be at least partially immersed in a lagoon over which said cover extends.

23. A cover section according to claim 1 wherein said relative movement between said lagoon cover section and said at least one corresponding cover section includes a hinge-like connection between said adjacent ones of said sections.

24. A cover section according to claim 1 wherein said buoyancy means supports said lagoon cover section such that said connecting means is disposed above said lagoon surface so as to be accessible for attachment and detachment of said lagoon cover section to and from said at least one corresponding cover section.

* * * * *

UNITED STATES PATENT AND TRADEMARK OFFICE

CERTIFICATE OF CORRECTION

PATENT NO. : 5,265,976

DATED : November 30, 1993

INVENTOR(S) : John V. Russell

It is certified that error appears in the above-identified patent and that said Letters Patent is hereby corrected as shown below:

Column 3, line 9, "1" should read --2--
Column 4, line 32, "Opposite" should read --opposite--
Column 6, line 19, "said to" should read --to said--

Signed and Sealed this

Third Day of May, 1994

Bruce Lehman

*Attest:*

BRUCE LEHMAN

*Attesting Officer*

*Commissioner of Patents and Trademarks*